US006722932B2

(12) United States Patent
Yanagihara

(10) Patent No.: US 6,722,932 B2
(45) Date of Patent: Apr. 20, 2004

(54) BRAKING DEVICE FOR WATERCRAFT

(75) Inventor: Tsuide Yanagihara, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/142,820

(22) Filed: May 8, 2002

(65) Prior Publication Data

US 2002/0168905 A1 Nov. 14, 2002

(30) Foreign Application Priority Data

May 8, 2001 (JP) ..... 2001-136928

(51) Int. Cl.[7] ..... B63H 11/11
(52) U.S. Cl. ..... 440/41; 114/145 R
(58) Field of Search ..... 114/145 R, 145 A; 440/40, 42, 38, 41

(56) References Cited

U.S. PATENT DOCUMENTS 3,159,134 A * 12/1964 Winnen ..... 114/145 R
5,813,357 A * 9/1998 Watson ..... 114/145 R
5,934,954 A * 8/1999 Schott et al. ..... 440/41
5,988,091 A * 11/1999 Willis ..... 114/145 R

FOREIGN PATENT DOCUMENTS

JP 2-254096 10/1990
JP 3-273994 12/1991

* cited by examiner

*Primary Examiner*—Stephen Avila
(74) *Attorney, Agent, or Firm*—Knobbe, Martens, Olson & Bear, LLP.

(57) ABSTRACT

A watercraft includes an improved braking device to assist slowing the watercraft when operated. The braking device includes a baffle plate and a guide plate. The baffle plate is movable between a non-braking position and a fully braking position. The guide plate cooperates with the baffle plate and is movable between a normal position and a fully deployed position. With the guide plate in the fully deployed position and the baffle plate in the fully braking position, the guide plate directs water against the baffle plate in order to slow the watercraft.

33 Claims, 4 Drawing Sheets

BRAKING DEVICE FOR WATERCRAFT

RELATED APPLICATION

This application is based on and claims priority to Japanese Patent Application No. 2001-136928, filed on May 8, 2001, the entire content of which is hereby incorporated by reference.

BACKGROUND OF THE INVENTION

1. Field of the Invention

The present invention relates generally to a braking device for a watercraft.

2. Description of Related Art

Relatively small watercrafts such as, for example, personal watercrafts have become very popular in recent years. This type of watercraft is quite sporting in nature and carries one or more riders. A hull of the watercraft typically defines a rider's area above an engine compartment. An internal combustion engine powers a jet propulsion unit that propels the watercraft by discharging water rearwardly. The engine lies within the engine compartment in front of a tunnel or gullet that is formed on an underside of the hull. The jet propulsion unit is placed within the tunnel and includes an impeller that is driven by the engine. The jet propulsion unit includes a discharge nozzle through which water is jetted and a deflector or steering nozzle disposed at an end of the nozzle to change a direction of the water jet.

A steering column is disposed at the front of the rider's area. The steering column typically is connected to a handle bar on which a throttle lever is provided. The handle bar is connected to the steering nozzle. The rider operates the throttle lever to control the power of the engine and thus the speed of the watercraft. The rider also can steer the handle bar to rotate the steering nozzle so as to change the direction of the watercraft's travel.

It has been previously proposed to employ a braking device to assist in slowing down the watercraft. For instance, Japanese Laid Open Publication No. H02-254096 discloses an exemplary braking device. That braking device includes a baffle plate to baffle water from flowing smoothly along a bottom surface of the hull. The baffle plate is normally housed in a recessed portion of the hull. When the rider steps on a pedal, the baffle protrudes below the bottom surface of the hull. In the lowered position, however, the baffle is susceptible to damage as the baffle can strike underwater or floating objects such as, for example, driftwood.

SUMMARY OF THE INVENTION

The present invention relates to an improved braking device that can be selectively operated to assist in slowing the watercraft when desired, such as, when docking the watercraft. In a preferred mode, the braking device does not protrude below the bottom of the watercraft hull by any significant degree, thus reducing the possibility of damage caused by underwater or floating objects over which the watercraft may travel when braking.

One aspect of the present invention thus involves a resistance creating device that is employed on a watercraft and is selectively operated to slow the watercraft when desired. The watercraft comprises a hull having a bottom surface and a propulsion unit. When the propulsion unit propels the watercraft, water flows along the bottom surface of the hull as the watercraft travels across the water surface. The resistance creating device comprises a first member and a second member. The first member is movable between first and second positions and is arranged to impede at least a portion of the water flowing along the bottom surface of the hull when in the first position; however, when in the second position, the first member does not significantly impede water flow along the bottom surface of the hull. The second member also is movable between its own first and second positions. The second member is arranged such that, when the second member is in the first position, the second member directs the portion of water toward the first member in its first position. The second member is also arranged such that, when the second member is in the second position, the second member does not significantly alter the water flow along the bottom surface of the hull.

In accordance with another aspect of the present invention, a watercraft comprises a hull having a bottom surface, a jet propulsion unit configured to generate a water jet for propelling the hull, and an auxiliary unit affixed to the hull. The jet propulsion unit is disposed at a rear end of the hull and includes a discharge nozzle and a steering nozzle. The steering nozzle receives the water jet from discharge nozzle. The auxiliary unit defines a bottom surface that extends below at least a portion of at least one of the nozzles and is generally contiguous to the hull bottom surface. A brake is hinged onto the auxiliary unit for pivotal movement and is movable between a non-braking position and a fully braking position. The brake impedes water flow under the hull at least when placed in the fully braking position. A water guide also is hinged onto the auxiliary unit for pivotal movement. The water guide is movable between a non-guiding position and a fully guiding position. The water guide has a bottom surface that extends generally contiguously from at least a portion of the bottom surface of the auxiliary unit while placed in the non-guiding position. The water guide is also arranged to guide water flowing along the bottom surface of the auxiliary unit toward the brake at least when placed in the fully guiding position.

BRIEF DESCRIPTION OF THE DRAWINGS

These and other features, aspects and advantages of the present invention will now be described with reference to the drawings of a preferred embodiment that is intended to illustrate and not to limit the invention. The drawings comprise six figures.

DETAILED DESCRIPTION OF THE PREFERRED EMBODIMENT OF THE INVENTION

Figure 1:
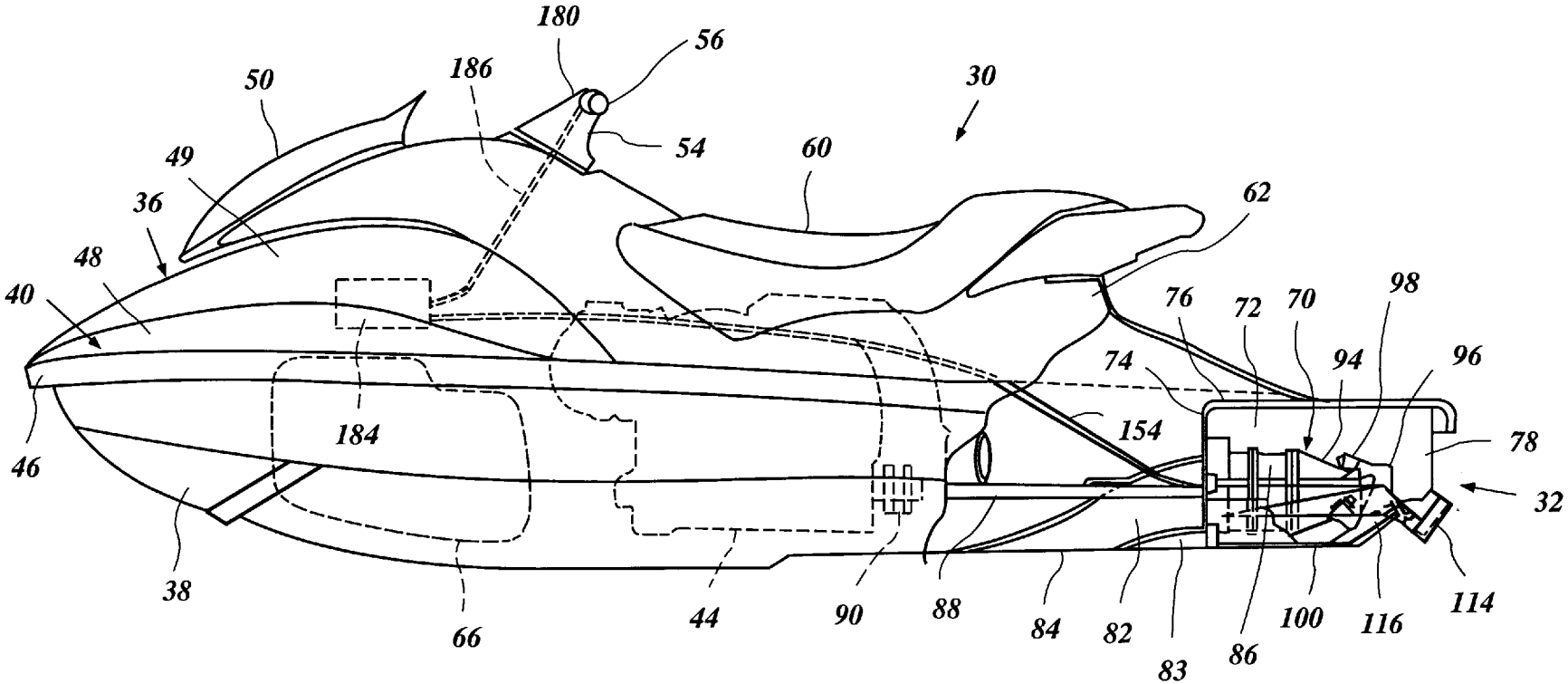
FIG. 1 is a side elevational view of a personal watercraft configured in accordance with a preferred embodiment of the present invention. Several internal components of the watercraft are illustrated in phantom. In addition, the aft end of the watercraft is sectioned to illustrate portions of a jet propulsion unit and braking device of the present invention.

FIG. 1 illustrates an overall construction of a personal watercraft 30 configured in accordance with a preferred embodiment of the present invention. The watercraft 30 includes a braking device or mechanism 32 at a rear end thereof. The braking device has particular utility in the context of a personal watercraft, and thus, is described in this context. The braking device, however, can be used with other types of watercrafts (i.e., jet boats, motor boats, etc.) as will become apparent to those of ordinary skill in the art.

The personal watercraft 30 includes a hull 36 formed with a lower hull section 38 and an upper hull section or deck 40. Both the hull sections 38, 40 are made of, for example, a molded fiberglass reinforced resin or a sheet molding compound. The lower hull section 38 and the upper hull section 40 are coupled together to form an internal cavity that defines at least an engine compartment 42. The engine compartment 42 houses an internal combustion engine 44 therein. An intersection of the hull sections 38, 40 is defined in part along an outer surface gunwale or bulwark 46.

In the illustrated embodiment, a bow portion 48 of the upper hull section 40 slopes upwardly rearwardly. The bow portion 48 preferably is formed with a pair of cover member pieces 49 that are split another along a center plane extending vertically and longitudinally fore to aft of the hull 36. Only one of the cover member pieces 49 is shown in FIG. 1; the other cover member pieces is disposed on the opposite side (i.e., on the starboard side of the watercraft 30). A hatch opening communicates with the internal cavity is formed at the bow portion 48 and a hatch cover 50 covers the opening and is hinged to open or detachably affixed to the bow portion 48.

A steering mast 54 extends generally upwardly to support a handle bar 56 atop thereof. The handle bar 56 is provided primarily for a rider to control the steering mast 54 in turning the hull 36 to the right or to the left. The handle bar 56 also carries control devices such as, for example, a throttle lever (not shown) for operating throttle valves of the engine 44. The throttle lever preferably is disposed on the starboard (right) side of the hull 40.

A seat 60 extends fore to aft over a seat pedestal 62 formed behind the steering mast 54. The seat 52 is generally configured as a saddle shape on which the rider can straddle. The seat 60 comprises a seat cushion and a rigid backing and is detachably affixed to the seat pedestal 62. An access opening preferably is defined on the top surface of the seat pedestal 62, under the seat 60, through which the rider can access the engine compartment 42. Foot wells preferably are defined on both sides of the seat pedestal 62 and at the top surface of the upper hull section 40. In general, the seat 60, the seat pedestal 62, the foot wells and the steering mast 54 together defines a rider's area.

A fuel tank 66 is placed in the engine compartment 42, preferably under the bow portion 48 and in front of the engine 44. One or more ventilation ducts preferably are provided so that ambient air can enter the engine compartment 42. Except for the ventilation ducts, the engine compartment 42 is substantially sealed to protect the engine 44, the fuel tank 66 and other internal systems or components from water.

The engine 44 can take any conventional constructions. Typically, the engine 44 can include an air intake system, an exhaust system, a fuel supply system, an ignition system and other systems that are normally provided. In the illustrated arrangement, a crankshaft of the engine 44 extends generally fore to aft along the center plane of the watercraft 30. An axis of the crankshaft is offset from the center plane.

A water jet propulsion unit or jet pump assembly 70 propels the watercraft 30. The propulsion unit 70 is mounted in a recess 72 formed on the rear underside of the lower hull section 38. More specifically, a bottom surface of the lower hull section 38 at its rear portion extends upwardly to define a forward wall 74 and then extends generally horizontally, as the watercraft is oriented in FIG. 1, toward the aft end to define an upper wall 76. A pair of side walls 78 extends downwardly, and preferably vertically, from the upper wall 76. The forward wall 74, the upper wall 76 and the side walls 78 together define the recess 72. The propulsion unit 70 preferably is affixed to the forward wall 74. Additionally or optionally, the propulsion unit 70 can be supported by the upper wall 76, the side walls 78 and/or a mounting plate or insert piece. The insert piece can be attached to the lower hull section 38 either within or outside the recess 72.

The lower hull section 38 also defines a tunnel or gullet 82 in front of the recess 72. The tunnel 82 communicates with an inner passage of the propulsion unit 70 through an opening formed on the forward wall 74. In the illustrated embodiment, the opening has generally an inverted U-shape. The tunnel 82 has a downward facing inlet port 84 opening toward a body of water. The rear edge of the part 84 is preferably defined by an intake duct piece or shoe 83. The propulsion unit 70 thus can draw in water from the body of water through the tunnel 82.

The jet propulsion unit 70 defines an impeller housing 86 that encloses an impeller therein at a center portion of the unit 70. An impeller shaft 88 extends forwardly from the impeller and is coupled with an intermediate shaft via a coupling unit 90. The impeller shaft 88 and the intermediate shaft extend generally along the center plane of the watercraft 30. The intermediate shaft is coupled with the crankshaft via a reduction gear train so that the intermediate shaft is driven by the crankshaft at a reduced speed relative to that of the crankshaft.

The rear end of the propulsion unit 70 defines a discharge nozzle 94. A deflector or steering nozzle 96 is affixed to the discharge nozzle 94 by a pair of bolts 98 for pivotal movement about a generally vertical steering axis. A cable (not shown) connects the steering nozzle 96 with the steering mast 54 so that the rider can rotate the steering nozzle 96 to steer the watercraft 30.

With the impeller spinning, water is drawn from the surrounding body of water through the inlet port 84 and the inner passage of the jet propulsion unit 70. The pressure generated in the propulsion unit 70 by the impeller produces a jet of water as the water exits through the discharge nozzle 94 and the steering nozzle 96. The water jet thus produces thrust to propel the watercraft 30. The rider can move the steering nozzle 96 with the handle bar 56 so as to steer the watercraft 30.

With continued reference to FIG. 1 and with additional reference to FIGS. 2–6, the braking device 32 and a construction of the hull around the braking device 32 will now be described below.

In the illustrated watercraft, a lower plate 100 (i.e., a ride plate), which is separately formed from the lower hull section 38, covers a bottom of the recess 72. The lower plate 100 is made of, for example, cast or sheet metal or metal alloy, or a molded fiberglass reinforced resin or a sheet molding compound, like the hull 36. The lower plate 100 extends fore to aft and generally horizontally, as the watercraft is oriented in FIG. 1. A bottom surface 102 of the lower plate 100 preferably extends generally contiguously from at least a portion of a bottom surface 104 of the lower hull section 38. In other words, the bottom surface 102 of the lower plate 100 extends generally at the same level as at least a portion of the bottom surface 104 of the lower hull section 38; however, in some applications, a step section and/or a gap can exist between the hull bottom surface 104 and the lower plate bottom surface 102. In addition, the port and starboard side edges of the lower plate 100 can lie generally flush with and contiguous to the adjacent hull bottom surface 104.

The lower plate 100 preferably comprises at least a bottom section 105 and a pair of side sections 106 that slant outwardly and upwardly from the sides of the bottom section 105. Each side sections 106 is coupled with the lower hull section 38, preferably to either side of the recess 72.

Figure 2:
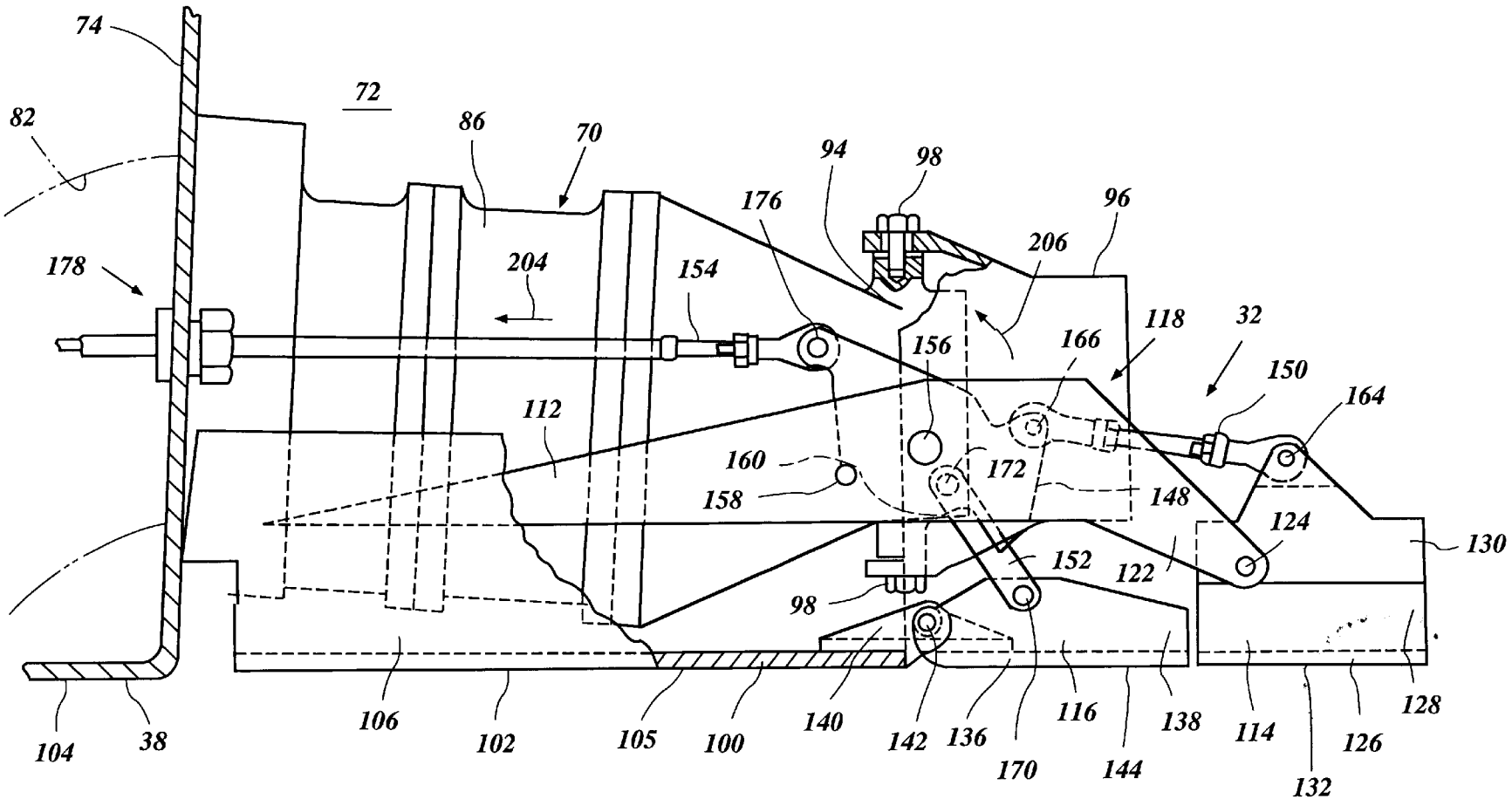
FIG. 2 is an enlarged side elevational view of the watercraft shown in FIG. 1. The figure particularly illustrates the jet propulsion unit and the braking device under a non-braking condition.
Figure 3:
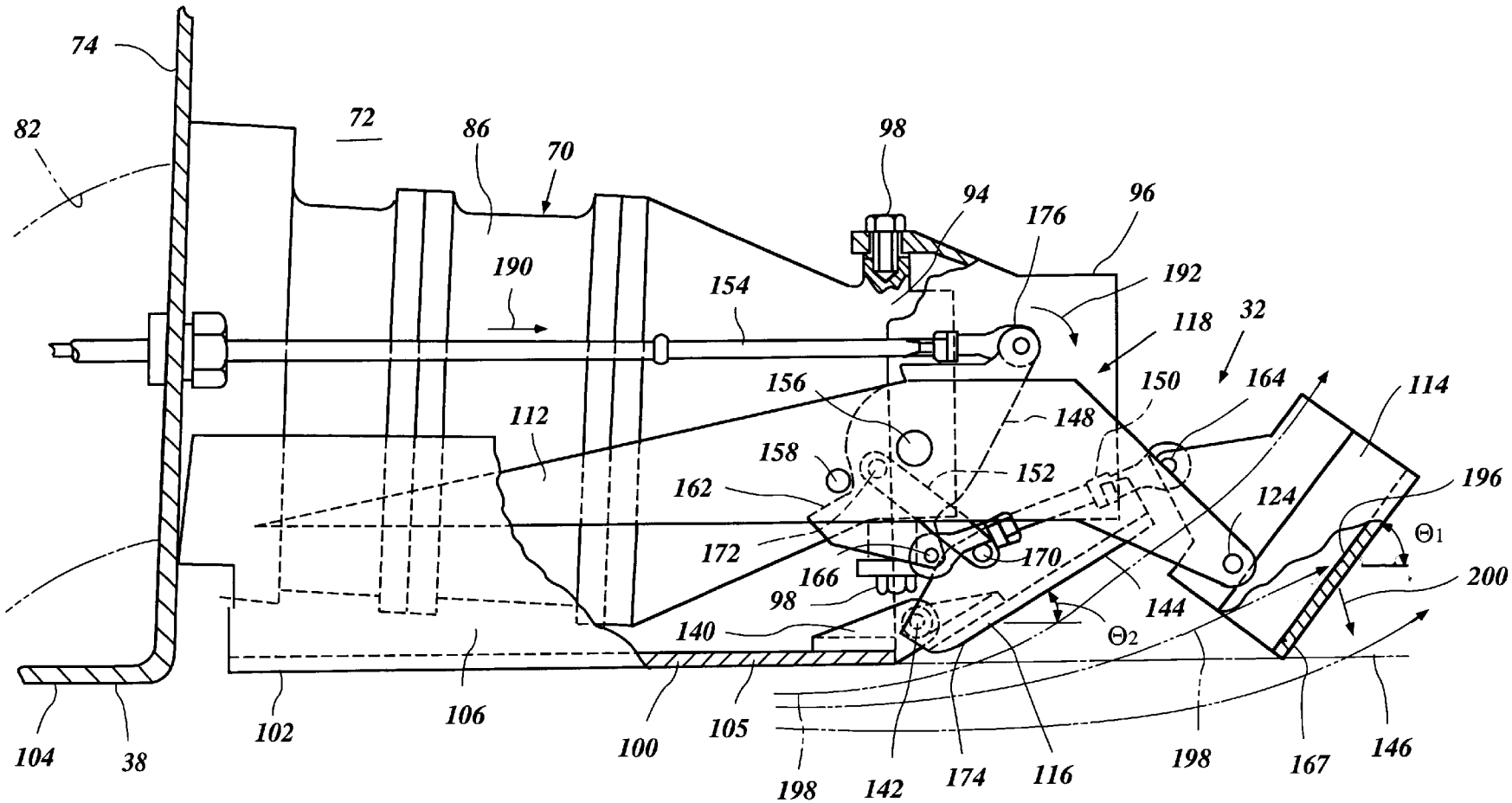
FIG. 3 is another enlarged side elevational view of the watercraft. The figure illustrates the jet propulsion unit and the braking device under a fully braking condition.
Figure 4:
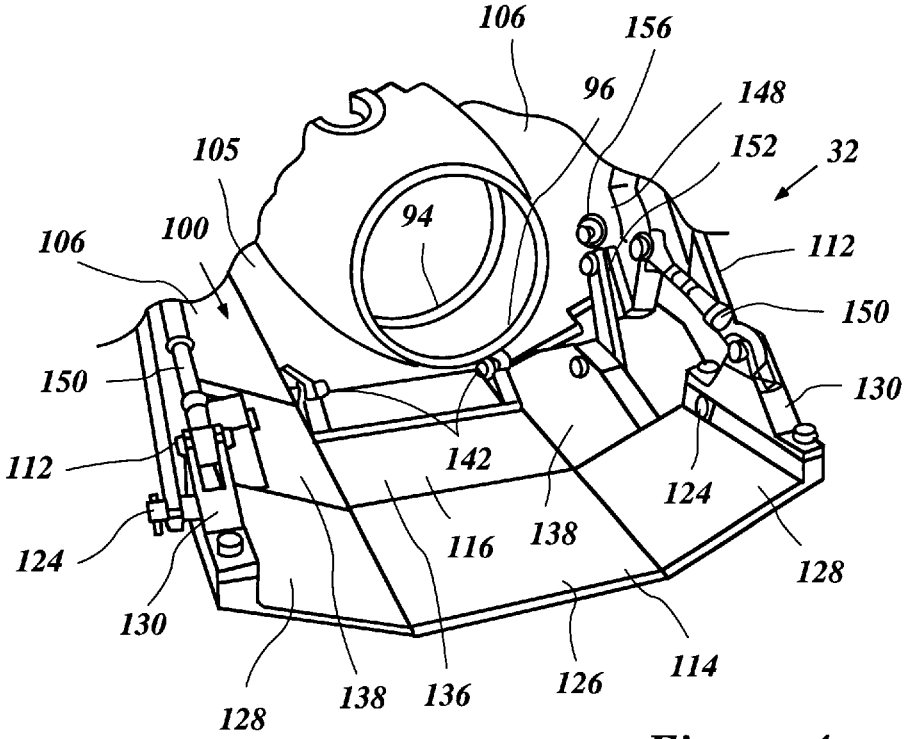
FIG. 4 is a perspective view of the watercraft of FIG. 1 taken at a rear location on the port side.
Figure 5:
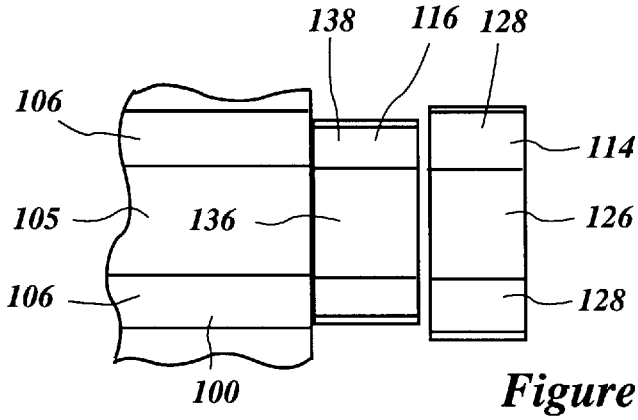
FIG. 5 is a schematic top plan view of a combination of a lower plate, a guide plate and a baffle plate under the non-braking condition.
Figure 6:
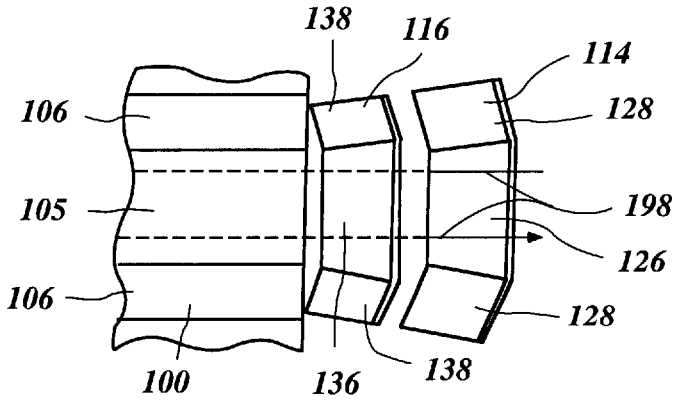
FIG. 6 is a schematic top plan view of the combination of the lower plate, the guide plate and the baffle plate under the fully braking condition.

As best seen in FIGS. 2–4, the braking device 32 preferably comprises a pair of brackets 112, a baffle plate 114, a water guide plate 116 and a control mechanism comprising at least a pair of control linkages 118.

The illustrated brackets 112 are shaped generally as a tapering triangle, although any configurations can be selected. The brackets 112 extend fore to aft generally along the side sections 106 of the lower plate 100 and at least each forward portion of the brackets 112 preferably is connected to the side sections 106. Alternatively, the brackets 112 can be unitarily formed with the lower plate 100 or can be coupled to the hull in a manner independent of the lower plate 100 (e.g., supported by the jet propulsion unit or attached to a mounting plate disposed at the front end of the recess). The brackets 112 preferably are made of, for example, a metal, a metal alloy or a molded fiberglass reinforced resin or a sheet molding compound. In the illustrated embodiment, the lower plate 100 and the brackets 112 together form an auxiliary unit that is attached to the hull and is disposed beneath at least a portion of the jet propulsion unit.

In the illustrated embodiment, each bracket 112 has an arm 122 that extends rearward and downward beyond a rear end of the steering nozzle 96; however, the arms can also have a shorter or longer length than illustrated. The baffle plate 114 is pivotally supported on the brackets 112 by a pair of shafts 124 that are connected to the arms 122 and preferably extended along a generally traverse axis. In the illustrated embodiment, the shafts 124 can rotate relative to the arms 112. While the baffle plate 114 preferably is disposed beyond the aft end of the steering nozzle 96 and arranged to have an effect on the water jet exiting the steering nozzle 96 when moved into its fully braking position, the baffle plate 114 does not need to extend into the water jet when moved into its fully braking position in order to slow the watercraft. The baffle plate 114 thus can be located forward of the effluent end of the steering nozzle 96 or can be located significantly below the steering nozzle so as not to interfere with the water jet exiting the steering nozzle 96.

The baffle plate 114 is made of, for example, a cast or sheet metal or metal alloy, or a molded fiberglass reinforced resin or a sheet molding compound, and preferably is configured generally flat. In the illustrated embodiment, the baffle plate 114 comprises a bottom section 126, a pair of side sections 128 slanting outwardly and upwardly from the bottom section 126 and bracket sections 130 extending vertically from the side sections 128. The baffle plate 114 thus has a generally similar shape to that of the lower plate 100; however, the baffle plate can take other shapes as well. The shafts 124 preferably are journaled at the bracket sections 130. A bottom surface 132 of the baffle plate 114 can extend at the same level as the bottom surface 104 of the lower hull section 38 similar to the bottom surface 102 of the lower plate 100 while the baffle plate 114 is disposed in its normal (i.e., a non-braking) position.

The water guide plate 116 is interposed between the lower plate 100 and the baffle plate 114. The guide plate 116 is made of, for example, a cast or sheet metal or metal alloy, or a molded fiberglass reinforced resin or a sheet molding compound, and preferably is configured generally flat. In the illustrated embodiment, the guide plate 116 comprises a bottom section 136 and a pair of side sections 138 slanting outwardly and upwardly from the bottom section 136. That is, the guide plate 116 also generally has a similar shape to that of the lower plate 100 and the baffle plate 114.

The guide plate 116 and the lower plate 100 can be viewed as part of one member of the braking device 32. The lower plate 100 is a fixed or stationary section of the member and the guide plate 116 is a movable section of the member.

The guide plate 116 is connected to the lower plate 100 by at least one hinge. In the illustrated embodiment, a pair of hinges 140 are affixed to a rear end of the bottom section 105 of the lower plate 100 and to a forward end of the bottom section 136 of the guide plate 116. Each hinge 140 includes a shaft 142 that has an axis extending generally transversely. The guide plate 116 thus can pivot about the axis of the shafts 142.

A bottom surface 144 of the guide plate 116 can extend at generally the same level as the bottom surface 104 of the lower hull section 38 while the guide plate 116 is placed in normal position (i.e. a non-guiding position). Accordingly, the bottom surfaces 104, 102, 144, 132 of the lower hull section 38, the lower plate 100, the guide plate 116 and the baffle plate 114 can extend one after another, generally contiguously, so as to define a generally even bottom surface when the baffle plate 114 and the guide plate 116 are in their normal positions. The line 146 of FIG. 3 indicates a line on which these bottom surfaces of the plate's center sections normally extend. In the non-braking, normal position, even the lowest portion, i.e., most-forward portion 167, of the baffle plate 114, preferably does not extend below the line 146. Similarly, in the non-guiding, normal position, even the lowest portion, i.e., most-forward portion 174, of the guide plate 116, preferably does not extend below the line 146.

The control linkages 118 are disposed on opposite sides of the braking device 32 with the steering nozzle 96 lying generally between the control linkages 118. Each control linkage 118 preferably comprises a rotary lever (first lever) 148, a turnbuckle (second lever) 150, a link (third lever) 152 and a push-pull cable 154.

The rotary levers 148 are pivotally supported on the brackets 112 by a pair of shafts 156 that are connected to the center portions of the brackets 112 for pivotal movement about an axis that extends generally transversely. Each bracket 112 includes a stopper pin 158 that extends toward the corresponding rotary lever 148, while each rotary lever 148 has two abutment portions 160, 162. The abutment positions 160, 162 can contact the stopper pin 158 to limit the rotation of the rotary lever 148 in both clockwise and counter-clockwise directions.

Each turnbuckle 150 connects the baffle plate 114 with the corresponding rotary lever 148. In the illustrated embodiment, shafts 164 are journaled on the baffle plate 114 atop the bracket sections 130 for pivotal movement about an axis that extends generally transversely. Other shafts 166 also are journaled on the rotary lever 148 for pivotal movement about an axis that also extends generally transversely. The baffle plate 114 thus can tilt from the non-braking position to a fully braking position and can rest in any position between the non-braking position and the fully braking position. The baffle plate 114, however, cannot exceed the range of positions established through the interaction between the stoppers 158 and the rotary lever abutment. The turnbuckles 150 preferably can vary their own lengths so that a tilt angle of the baffle plate 114, which will be described shortly, is variable. Alternatively, a link that has a fixed length can replace the turnbuckle 150.

Each link 152 connects the water guide plate 116 with the corresponding rotary lever 148. Shafts 170 are journaled on the guide plate 114 atop the side sections 138 for pivotal movement about an axis extending generally transversely. Other shafts 172 also are journaled on the rotary lever 148 for pivotal movement about an axis extending generally transversely. The guide plate 116 thus can tilt from the non-guiding position to a fully guiding position and can rest in any position between the non-guiding position and the fully guiding position. The guide plate 116, like the baffle plate 114, cannot exceed the range of positions established by the stoppers 158 and the abutment positions 160, 162. In the illustrated embodiment, the respective turnbuckle 150, link 152 and rotary lever 148, which are disposed on one side of the jet propulsion unit, preferably lie at different distances from a longitudinally-extending, vertical central plane of the watercraft so as not to interfere with the one another's rotation as the baffle and guide plates are moved between their normal and braking/guiding positions.

By properly selecting the positions of the shafts 164, 166, 170, 172 and lengths of the turnbuckles 150 and the links 152, a tilt angle of the links 152 can differ from a tilt angle of the turnbuckles 150. In the illustrated arrangement, a fully tilted angle of the baffle plate 114 is set as $\theta_1$ and a fully tilted angle of the guide plate is set as $\theta_2$, which preferably is smaller than the tilt angle $\theta_1$. For example, but without limitation, the tilted angle $\theta_1$ can be 60 degrees, while the tilted angle $\theta_2$ can be 30 degrees. Additionally, the illustrated baffle plate 114 at least in part can be located right behind of the discharge opening of the steering nozzle 96 at least in the fully tilted position, as shown in FIG. 3.

Each push-pull cable 154 is pivotally connected to the corresponding rotary lever 148 by a shaft 176. The shaft 176 is connected to an upper section of the rotary lever 148 for pivotal movement about an axis extending generally transversely. The push-pull cables 154 extend forwardly from the rotary levers 148 along both side of the jet propulsion units 70 and beyond the forward wall 74. Mount assemblies 178 preferably are provided at the vertical wall 74 to have the push-pull cables 154 pass through the vertical wall 74 while sealing the hull at these locations.

The push-pull cables 154 can be directly connected to a control lever 182 (FIG. 1), which preferably is disposed on the port side (left side) of the handle bar 56. In this arrangement, the gripping and releasing operation of the control lever 182 is directly converted into the pushing and pulling movement of the push-pull cable. Due to certain weights of the baffle, guide plates 114, 116, and the control linkages 118, occasionally it may be somewhat difficult for a rider to operate the control lever 180. In the illustrated arrangement, a booster or power assist mechanism 184 is provided to assist the rider to operate the control lever 180. The power assist mechanism 184 can comprise a mechanical system such as, for example, a hydraulic system boosting up the operational force of the rider. The booster 184 preferably is connected to the control lever 180 by another push-pull cable 186. Alternatively, an electrical system such as, an electric motor or actuator, can replace the mechanical system. In this alternative arrangement, an on-off switch and an electrical control cable can replace the control lever 180 and the push-pull cable 186, respectively.

When the rider does not intend to operate the braking device 32, the rider does not operate the control lever 180. Under such circumstances, the braking device 32 is in the state shown in FIG. 2. That is, the baffle plate 114 is placed in the non-braking position and the guide plate 116 is placed in the non-guiding position. In this state, all the bottom surfaces 104, 102, 144, 132 of the lower hull section 38, the lower plate 100, the guide plate 116 and the baffle plate 114 generally align one after another on the bottom surface line or keel line 146 of FIG. 3. Thus, the water flowing along the bottom surface 104 of the lower hull section 38 continuously flows along the respective bottom surfaces 104, 102, 144, 132 and the braking device 32 does not significantly affect the running condition of the watercraft 30.

When operating the braking device 32, the rider grasps the control lever 180. The push-pull cable 186 operates the booster 184 to generate the assist power. The booster 184 then actuates the push-pull cable 154 with the assist power. The push-pull cable 154 pushes the rotary lever 148 as indicated by the arrow 190 of FIG. 3 so that the rotary lever 148 pivots as indicated by the arrow 192. With the rotary lever 148 pivoting, the baffle plate 114 and the guide plate 116 together tilt as shown in FIG. 3. If the rider fully grasps the control lever 180, the baffle plate 114 and the guide plate 116 are brought to the fully tilted position, i.e., fully braking position. The rider can adjust the grasping force so that the both plates 114, 116 are placed in any position between the non-braking position and non-guiding position and the braking position and guiding position, respectively.

Under the state such that the baffle plate 114 and the guide plate 116 are tilted at any angle, the water flowing along the bottom surfaces 104, 102 of the lower hull section 38 and the lower plate 100, respectively, turns slightly upwardly along the bottom surface 144 of the guide plate 116. Some of the water then impinges upon an upper surface 196 of the baffle plate 114 as indicated by the arrow 198 in FIG. 3. Additionally, because the illustrated baffle plate 114 extends right behind the opening of the steering nozzle 96, the water jetted from the steering nozzle 96 also impinges upon the upper surface 196 of the baffle plate 114. The shock of the water to the baffle plate 114 creates resistance that can prevent the watercraft 30 from advancing. In other words, the water acts as a brake to decrease the advancing speed of the watercraft 30. The baffle plate's interference with the water jet also reduces the resulting thrust upon the watercraft.

In addition, either the water coming from the bottom surface 144 of the guide plate 116 or coming from the steering nozzle 96 pushes the baffle plate 114 generally downwardly as indicated by arrow 200 because the baffle plate 114 extends upwardly and rearward. As a result, the bow portion 48 of the watercraft 30 rises. As a result, the so-called "bow dive" does not occur.

In the illustrated arrangement, the tilt angle $\theta_1$ of the baffle plate 114 is always greater than the tilt angle $\theta_2$ of the guide plate 116 as described above. This arrangement is advantageous because the water coming from the bottom surface 144 of the guide plate 116 can forcefully impinge upon the baffle plate 114. Both the braking effect and the bow dive inhibiting effect can be significant. Additionally, the tilt angle $\theta_1$ of the baffle plate 114 can be varied because the turnbuckles 150 are used in the illustrated arrangement. Thus, the intensity of the stopping effect can be adjustable. Similarly, the tilt angle $\theta_2$ of the guide plate 116 can be varied if turnbuckles are used in place of the links 152. Thus, both the tilt angle $\theta_2$ of the guide plate 114 and the tilt angle $\theta_2$ of the guide plate 116 can vary by using turnbuckles; however, fixed length links can replace the turnbuckles connected to either the guide plate 116 and/or the baffle plate 114 in other variations of the control mechanism.

Because the guide plate 116 can efficiently guide the water flowing along the bottom surfaces 104, 102 of the lower hull section 38 and the lower plate 100 toward the baffle plate 114, the baffle plate 114 does not need to protrude below the bottom surface line 146. The guide plate 116 also need not protrude under the line 146 either. Accordingly, the braking device 32 is less likely to be damaged by submerged or floating objects while braking the watercraft 30.

The rider releases the control lever 180 to release the braking device 32. When the push-pull cable 154 pulls the rotary lever 148 as indicated by the arrow 204 of FIG. 3, the rotary lever 148 pivots in the direction indicated by the arrow 206. With the rotary lever 148 pivoting in this direction, the baffle plate 114 and the guide plate 116 together move back to the inline normal positions, as shown in FIG. 2.

Of course, the foregoing description is that of a preferred construction having certain features, aspects and advantages in accordance with the present invention. It will be understood by those skilled in the art that the present invention extends beyond the specifically disclosed embodiment to other alternative embodiments and/or uses of the invention and obvious modifications and equivalents thereof. Various changes and modifications can be made to the above-described embodiment without departing from the spirit and scope of the invention. For instance, in many applications, the booster can be omitted. It thus is intended that the scope of the present invention herein disclosed should not be limited by the particular disclosed embodiment described above, but should be determined only by a fair reading of the claims that follow.

What is claimed is:

1. A watercraft comprising a hull having a bottom surface, a propulsion unit, and resistance creating device comprising a first member and a second member, the first member being movable between first and second positions and being arranged to impede at least a portion of water flowing along the bottom surface of the hull when in the first position and to not significantly impede water flow along the bottom surface of the hull when in the second position, the second member also being movable between its own first and second positions, the second member being arranged such that, when the second member is in the first position, the second member directs the portion of water toward the first member in its first position and, when the second member is in the second position, the second member does not significantly alter the water flow along the bottom surface of the hull.

2. The watercraft as set forth in claim 1, wherein both the first member and the second member are raised upward relative to the hull bottom surface when in the respective first positions.

3. The watercraft as set forth in claim 1, wherein the first member is pivotally moveable between the first and second positions.

4. The watercraft as set forth in claim 3, wherein the second member is pivotally moveable between the first and second positions.

5. The watercraft as set forth in claim 4, wherein the first and second members extend generally horizontally in the respective second positions, the first and second members tilt so that respective forward ends of the first and second members are placed lower than respective rear ends thereof in the respective first positions, and a tilt angle of the first member is greater than a tilt angle of the second member.

6. The watercraft as set forth in claim 4, wherein the first and second members extend generally horizontally in the respective second positions, the first and second members tilt so that respective forward ends of the first and second members are placed lower than respective rear ends thereof in any positions other than the second positions, and a tilt angle of the first member is greater than a tilt angle of the second member.

7. The watercraft as set forth in claim 1, wherein the second member is pivotally moveable between the first and second positions.

8. The watercraft as set forth in claim 1, wherein the first and second members are generally above a bottom surface of the hull when lying in any positions between the respective first and second positions.

9. The watercraft as set forth in claim 1, additionally comprising a control mechanism configured to move the first member and the second member together between their respective first and second positions.

10. The watercraft as set forth in claim 9, wherein the control mechanism includes a linkage assembly connecting the first and second members with each other, the linkage assembly simultaneously shift the first and second members between the respective first and second positions.

11. The watercraft as set forth in claim 9, additionally comprising a bracket assembly affixed to the hull, the first member being pivotally connected to the bracket assembly for a pivotal movement about a first axis that extends generally transversely, the second member being pivotally connected to the bracket assembly for a pivotal movement about a second axis that extends generally transversely, the control mechanism including a first lever pivotally connected to the bracket assembly for a pivotal movement about a third axis that extends generally transversely, a second lever pivotally connected to the first lever for a pivotal movement about a fourth axis that extends generally transversely and to the first member for a pivotal movement about a fifth axis that extends generally transversely, and a third lever pivotally connected to the first lever for a pivotal movement about a sixth axis that extends generally transversely and to the second member for a pivotal movement about a seventh axis that extends generally transversely, the first and second members and the levers are arranged such that the first and second members simultaneously pivot about the first and second axes, respectively, when the first lever pivots about the third axis.

12. The watercraft as set forth in claim 11, wherein a length of the second lever is adjustable.

13. The watercraft as set forth in claim 11, wherein the control mechanism additionally comprises a push-pull cable connected to the first lever.

14. The watercraft as set forth in claim 1, wherein the first member has a generally flat configuration.

15. The watercraft as set forth in claim 14, wherein the first member has a center portion and two side portions that extend outward from the center portion, and the center portion of the first member extends generally horizontally and both side portions of the first member slant upwardly.

16. The watercraft as set forth in claim 1, wherein the second member is generally configured flat.

17. The watercraft as set forth in claim 1, wherein the first and second members are generally configured in the same shape.

18. The watercraft as set forth in claim 17, wherein the first and second members are generally aligned with each other when the first and second members are in the respective second positions.

19. The watercraft as set forth in claim 1, wherein the propulsion unit is a jet propulsion unit configured to generate water jet for propelling the hull.

20. A watercraft comprising a hull having a bottom surface, a propulsion unit, and a resistance creating device comprising first, second and third members, the first member being generally stationary relative to the hull, the second member being movable between first and second positions, the third member being interposed between the first and second members, the third member being movable between its own first and second positions, the second member being arranged to impede at least a portion of water flowing along a bottom surface of the first member when in the first position and to not significantly impede water flow along the bottom surface of the first member when in the second position, and the third member being arranged such that, when the third member is in the first position, the third member directs the portion of water toward the second member in its first position and, when the third member is in the second position, the third member does not significantly alter the water flow along the bottom surface of the first member.

21. The watercraft as set forth in claim 20, wherein the hull has a water inlet that communicates with the propulsion unit and that lies forward of the resistance creating device, and the first member has a bottom surface that extends generally at the same level as a bottom surface of the hull just forward of the water inlet.

22. The watercraft as set forth in claim 21, wherein the third member has a bottom surface that extends generally at the same level as the bottom surface of the first member when the third member is in the second position.

23. A watercraft comprising a hull, a jet propulsion unit configured to generate a water jet for propelling the hull, the jet propulsion unit being disposed at an aft end of the hull and including a discharge nozzle and a steering nozzle, the steering nozzle receiving the water jet from discharge nozzle, an auxiliary unit affixed to the hull, the auxiliary unit defining a bottom surface extending below at least one of the nozzles, a brake hinged onto the auxiliary unit for pivotal movement, the brake moving between a non-braking position and a fully braking position, the brake impeding water flow under the hull at least when placed in the fully braking position, and a water guide hinged onto the auxiliary unit for pivotal movement, the water guide moving between a non-guiding position and a fully guiding position, the water guide having a bottom surface that extends generally contiguously from at least a portion of the bottom surface of the auxiliary unit while placed in the non-guiding position, and the water guide arranged to guide water flowing along the bottom surface of the auxiliary unit toward the brake at least when placed in the fully guiding position.

24. The watercraft as set forth in claim 23 additionally comprising an interlocking mechanism, the brake and the water guide are interlocked with each other by the interlocking mechanism in moving from the non-braking position to the fully braking position and from the non-guiding position to the fully guiding position, respectively.

25. The watercraft as set forth in claim 24, wherein the auxiliary unit comprises a bracket carrying the interlocking mechanism, and a lower member defining at least a portion of the bottom surface of the auxiliary unit.

26. The watercraft as set forth in claim 23, wherein the brake is positioned generally higher than the bottom surface of the hull at any position between the non-braking position and the fully braking position.

27. The watercraft as set forth in claim 23, wherein the water guide is positioned generally higher than the bottom surface of the hull at any position between the non-guiding position and the fully guiding position.

28. The watercraft as set forth in claim 23, wherein the brake is disposed such that the brake extends above a lower side of the steering nozzle when in the fully braking position.

29. The watercraft as set forth in claim 23, wherein the brake and the water guide tilt from the non-braking position and the non-guiding position, respectively, and respective tilt angles are different from each other.

30. The watercraft as set forth in claim 29, wherein the tilt angle of the brake is greater than the tilt angle of the water guide.

31. A watercraft comprising a hull having a bottom surface, a propulsion unit configured to introduce a first portion of water to generate water jet for propelling the hull, braking means for selectively impeding a second portion of water that flows along the bottom surface of the hull and guiding means for selectively directing the second portion of water flow toward the braking means at least when the braking means is operated to slow movement of the watercraft.

32. The watercraft as set forth in claim 31, wherein the braking means and guiding means are selectively operable in a synchronized motion.

33. The watercraft as set forth in claim 31, wherein the braking means and the guiding means are generally located above a bottom surface of the hull when operated to slow the watercraft.

* * * * *